United States Patent [19]

Fair et al.

[11] Patent Number: 4,469,571

[45] Date of Patent: Sep. 4, 1984

[54] REPLACEMENT OF A STRUCTURALLY DAMAGED MEMBRANE

[75] Inventors: David L. Fair, Chattanooga; Kenneth E. Woodard, Jr.; Robert A. Dean, both of Cleveland, all of Tenn.

[73] Assignee: Olin Corporation, New Haven, Conn.

[21] Appl. No.: 519,356

[22] Filed: Aug. 1, 1983

[51] Int. Cl.[3] ..... C25B 1/08; C25B 1/46; B22D 19/10

[52] U.S. Cl. ..... 204/98; 204/128; 204/257; 204/258; 29/402.03; 29/402.08

[58] Field of Search ..... 204/257, 258, 98, 128, 204/253, 254, 255, 256; 29/402.03, 402.08

[56] References Cited

U.S. PATENT DOCUMENTS

| | | | |
|---|---|---|---|
| 3,811,317 | 5/1974 | Leonard et al. | 73/40 |
| 3,937,064 | 2/1976 | Wolf, Jr. et al. | 73/40 |
| 4,032,423 | 6/1977 | Cunningham | 204/254 |
| 4,090,924 | 5/1978 | Bon | 204/1 T |
| 4,153,532 | 5/1979 | Fitch et al. | 204/267 |
| 4,288,310 | 9/1981 | Knight et al. | 204/258 |
| 4,311,577 | 1/1982 | Kircher | 204/257 |
| 4,367,134 | 1/1983 | Kircher | 204/257 |
| 4,381,984 | 5/1983 | Kircher | 204/258 |
| 4,431,495 | 2/1984 | Fair | 204/257 |

FOREIGN PATENT DOCUMENTS

| | | | |
|---|---|---|---|
| 2821981 | 11/1979 | Fed. Rep. of Germany | 204/267 |

*Primary Examiner*—R. L. Andrews
*Assistant Examiner*—Terryence Chapman
*Attorney, Agent, or Firm*—Ralph D'Alessandro; Donald F. Clements; Thomas P. O'Day

[57] ABSTRACT

Disclosed is a method of replacing a structurally damaged membrane after determining which membrane in a multiple unit filter press membrane electrolytic cell is damaged in response to cell operating conditions and monitorings indicating a problem exists.

21 Claims, 4 Drawing Figures

REPLACEMENT OF A STRUCTURALLY DAMAGED MEMBRANE

BACKGROUND OF THE INVENTION

This invention relates generally to filter press membrane electrolytic cells. More specifically, it relates to a method for replacing membranes in a multiple unit filter press membrane electrolytic cell.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type.

Comparatively recent technological advances, such as the development of dimensionally stable anodes and various coating compositions, have permitted the gap between electrodes to be substantially decreased or eliminated entirely. This has dramatically increased the energy efficiency during the operation of these energy-intensive units.

The development of a hydraulically impermeable membrane has promoted the advent of filter press membrane chloralkali cells which produce a relatively uncontaminated caustic product. This higher purity product obviates the need for caustic purification and concentration processing. The use of a hydraulically impermeable planar membrane has been most common in bipolar filter press membrane electrolytic cells. However, continual advances have been made in the development of monopolar filter press membrane cells.

The use of a hydraulically impermeable membrane, however, presents problems should the membrane become structurally damaged, such as ruptured by the passage of a sharp object therethrough. Since commercial size filter press membrane cells comprise multiple cathode and anode units separated by a membrane, there may be up to twenty four or more membranes in each electrolytic cell unit. The exact position of a structurally damaged membrane in a electrolytic cell unit employing multiple membranes is difficult to identify without taking apart the entire filter press cell.

Typically, structural damage to one or more membranes manifests itself in several symptomatic ways. Cathode current efficiency and anode current efficiency decrease when a membrane is damaged. The cathode current efficiency decreases are detectable, such as by physically measuring the weight of the caustic produced in a container vessel and then calculating the production rate of caustic or by physically measuring the flow rate with appropriate means, for example flow totalizer units. The production rate of caustic is calculated by measuring the equivalents of caustic produced per current load and is measured in grams per gram equivalent.

The decrease in anode current efficiency is detectable because of an increase in the presence of oxygen and oxychlorides, such as hypochlorite, or chlorates, in the cell gas and the spent anolyte stream (spent brine). A change in the pH of the spent anolyte stream can also be an indicator of a decrease in anode current efficiency. The increase in the presence of oxygen may be determined by gas chromatograph testing, while the increase in the presence of oxychlorides can be detected by titration. The oxygen and oxychlorides are present because the caustic crosses through the membrane at the point of structural damage in back migration and starts to electrolyze or chemically react with the bulk anolyte. This puts hydroxyl ions back into a low pH environment which, depending on the type of anodes being used, will produce either oxygen, chlorite ions or chlorate ions.

Previously, when testing such as this detects the presence of decreased cathode current efficiency or decreased anode efficiency, the exact location of the structurally damaged membrane could be determined only by trial and error. This required that the entire electrolytic cell be taken apart and the anodes and cathodes be separated individually to check each membrane visually for structural damage. The entire process, including the diagnosis of a problem by the detection of a reduction in the cathode current efficiency or anode current efficiency and the breaking apart of the cells to find the damaged membrane or membranes could well take several days and up to a week. A loss of this much operating time for an electrolytic cell unit is costly and the steps necessary to correct the problem in this manner are labor intensive.

Once the location of the structurally damaged membrane is thusly identified, the practical problem of removing a single membrane in a multiple electrode unit filter press membrane cell, containing as many as 24 or more membranes, presents itself. Any shifting of the stack of electrodes with the membranes sandwiched between each pair of electrode frames during the cell disassembly and assembly can damage the membranes. This damage normally will be in the form of a tear to the membrane. Gasket misalignment could also occur, affecting the fluid-tight configuration of the assembled cell. Naturally, damage to additional membranes adds to the cost of the cell and requires more "down" or non-operating time to replace the damaged membranes.

Time consuming and labor intensive disassembly and assembly steps further compound the problem of replacing membranes. Prior approaches comprised breaking the entire cell apart by individually removing each electrode frame and membrane from the cell stack and replacing each electrode frame and membrane individually in the cell stack. The cell must first be disconnected from the electrical and electrolyte circulation circuits and then moved to a suitable disassembly area.

Where the entire cell is broken apart, each individual gasket adjacent each electrode frame must also be replaced to ensure a fluid-tight seal between the frames when the cell is reassembled. This is also a time consuming and labor intensive procedure.

Additionally, the prior approach would frequently damage more membranes than the originally damaged one because the membrane fibers would adhere to the surface of the gasket, whether gum, rubber or other material. This would result in the membranes tearing when the electrode frame with its attached gasket was removed from the stack.

The foregoing problems are solved by the improved method of replacing a structurally damaged membrane after determining the location of the damaged membrane in a multiple unit filter press membrane electrolytic cell in response to cell operating conditions and monitorings indicating the existence of a problem.

SUMMARY OF THE INVENTION

It is an object of the present invention to provide a method of replacing a structurally damaged membrane in a multiple unit filter press membrane electrolytic cell after determining the exact location of the damaged membrane without having to break the entire cell apart.

It is another object of the present invention to provide a simple and reliable method to replace a structurally damaged membrane in a filter press membrane electrolytic cell.

It is a feature of the present invention that a lubricating strip is employed between at least one side of the membrane and the adjacent gasket to prevent the membrane from adhering to the gasket.

It is another feature of the method of the present invention that the electrode stack in the filter press membrane cell is separated at the damaged membrane into two distinct units.

It is another feature of the method of the present invention that a lifting fixture is used to separate the cell electrode stack into two distinct units.

It is an advantage of the method of the present invention that the entire electrolytic cell unit does not have to be broken down by individual electrode frames to replace a damaged membrane.

It is another advantage of the present invention that a minimal amount of time is expended to replace the structurally damaged membrane.

It is a further advantage of the method of the present invention that damage to adjacent membranes is avoided when replacing a structurally damaged membrane in an electrolytic cell unit.

It is still another advantage of the method of the present invention that gasket replacement is minimized to only those gaskets adjacent the exposed electrode frame adjacent the structurally damaged membrane.

These and other objects, features and advantages are obtained in the method of replacing a structurally damaged membrane in a filter press membrane electrolytic cell containing electrolyte by electrically disconnecting the electrolytic cell from the electrical power source, disconnecting the brine and the deionized water infeed lines, draining the electrolyte from the electrolytic cell, locating the structurally damaged membrane, removing the cell unit to a disassembly area, separating the stack of electrodes at the damaged membrane into two distinct units, replacing the structurally damaged membrane with a new membrane and assembling the cell stack.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

It is to be understood that the filter press membrane cell described in the instant disclosure includes a plurality of electrodes. Electrodes are anodes and cathodes arranged in alternating sequence as will be described in greater detail hereafter. The term "anode" or "cathode" is intended to describe the entire electrode unit which is comprised of a frame that encases the periphery of the appropriate electrode and on opposing sides has anodic or cathodic surfaces, as appropriate. The space within the individual electrode between the electrode surfaces comprises a major portion of the compartment which is filled with anolyte or catholyte fluid, as appropriate during the electrolytic process. The particular compartment is defined by the pair of membranes that are placed adjacent, but exteriorly of the opposing electrode surfaces, thereby including the opposing electrode surfaces within each compartment. The term "anode" or "cathode" is further intended to encompass the electrical conductor rods that pass the current through the appropriate electrode, as well as any other element that comprise the entire electrode unit.

Figure 1:
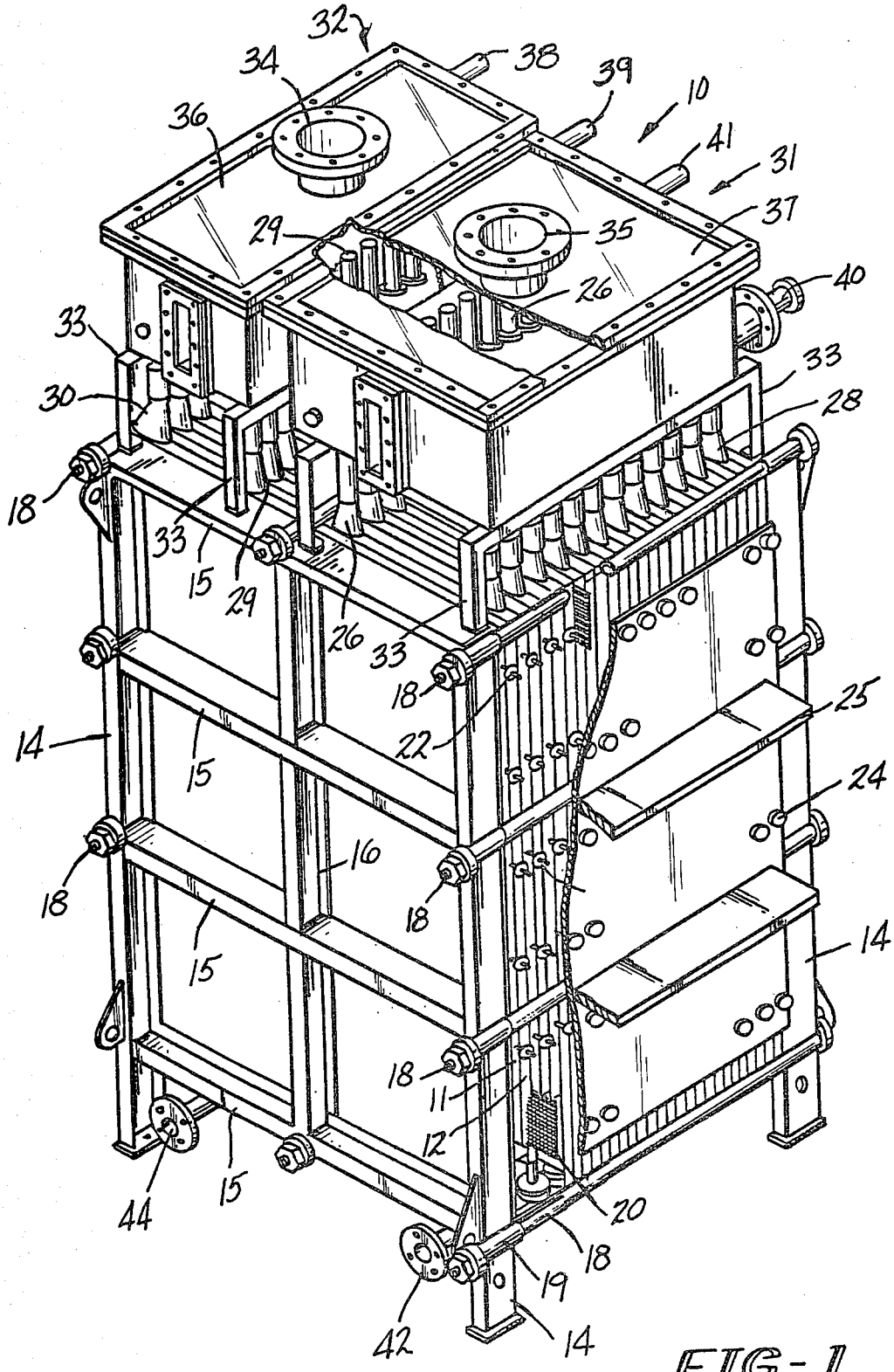
FIG. 1 is a side perspective view of a monopolar filter press membrane electrolytic cell with appropriate portions broken away to illustrate the anodes, cathodes, anolyte disengager, catholyte disengager, the anolyte and catholyte infeed manifolds, and the relative positioning of the membranes between the adjacent anodes and cathodes.

Referring now to FIG. 1, a filter press membrane cell, indicated generally by the numeral 10, is shown in a side perspective view. It can be seen that the cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 18 which are inserted through appropriate mounting means affixed to the vertical side frame members 14 and horizontal side frame members 15. To prevent short circuiting between the electrodes during the electrolytic process, the tie bolts 18 have tie bolt insulators 19 through which the tie bolts 18 are passed in the area of the cathodes 11 and anodes 12. As seen in FIG. 1, the insulators 19 are broken away for clarity to show the tie bolts 18 and electrode frames, but it should be understood that they extend across the entire length of the cell 10.

Figure 2:
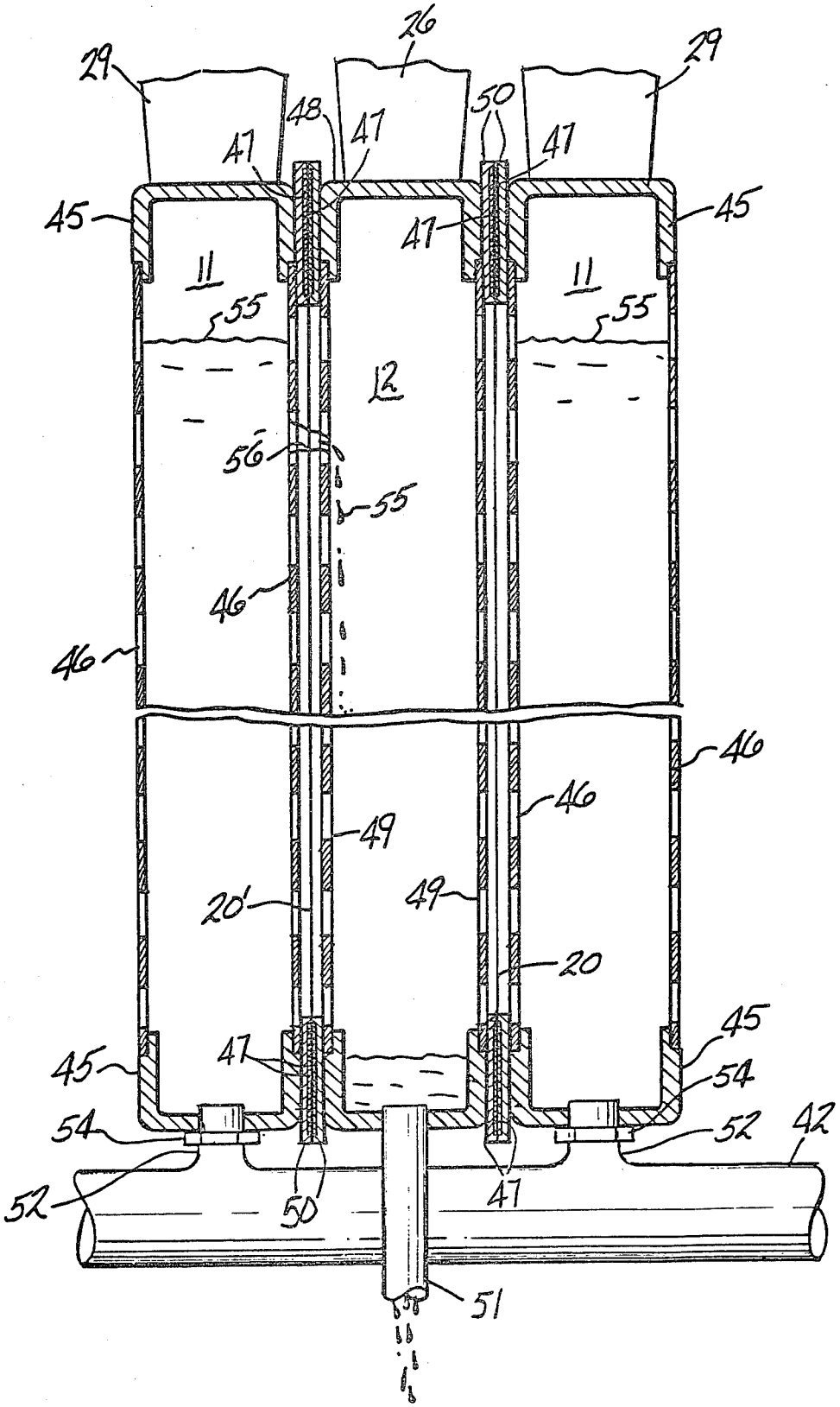
FIG. 2 is an enlarged diagramatic sectional illustration of adjacently positioned anode and cathodes with a structurally damaged membrane therebetween showing the passage of the test liquid through the structurally damaged membrane into the adjacent electrode to identify the location of the damaged membrane.

Electrical current is passed, for example, from an external power source through the anode bus and then via anode bus bolts into the anode conductor rods, all not shown. From that point, the anode conductor rods pass the current into the anodic surfaces, also not shown in FIG. 1. The current continues flowing through the membrane 20, through the opposing cathodic surfaces (not shown in FIG. 1), the cathode conductor rods 22 and the cathode bus bolts 24 to the cathode bus 25. At this point the electrical current continues its path out of the cell 10. The anodic conducting means are present on the opposite side of the filter press membrane cell 10 from the cathodic conducting means. Ion-selective permeable membranes 20 are diagramatically shown in FIG. 1 to illustrate how each pair of anodes anodes 12 and cathodes 11 are separated by the membranes. FIG. 2 shows this in better detail.

Projecting from the top of anodes 12 and cathodes 11 are a series of anode and cathode risers used for fluid flow between the appropriate gas-liquid disengager and the corresponding electrode. FIGS. 1 and 2 show anode risers 26 and anode downcomers 28, which project from the top of each anode 12. Similarly, cathode risers 29 and cathode downcomers or catholyte return lines 30 are shown projecting from the top of each cathode 11. The risers are generally utilized to carry the appropriate electrolyte fluid with the accompanying gas, either anolyte with chlorine gas or catholyte with hydrogen gas, to the appropriate disengager mounted atop of the filter press membrane cell 10.

The anolyte disengager is indicated generally by the numeral 31, while the catholyte disengager is indicated generally by the numeral 32. Each disengager is supported atop of the cell 10 by disengager supports 33, seen in FIG. 1. It is in each of these disengagers that the entrained gases is enabled to separate from the liquid of the anolyte or the catholyte fluid, as appropriate, and is released from the appropriate disengager via either a cathode gas release pipe 34 or an anode gas release pipe 35 affixed to the appropriate catholyte disengager cover 36 or anolyte disengager cover 37.

Also partially illustrated in FIG. 1 is a catholyte replenisher or infeed conduit 38 which carries deionized water into the catholyte disengager 32. Deionized water is appropriately fed through the catholyte disengager 32 to each cathode frame 11 in cell 10. A catholyte outlet pipe 39 is also partially illustrated and serves to control the level of liquid fluid in the catholyte disengager 32 by removing caustic to the appropriate processing apparatus.

An anolyte replenisher or brine infeed conduit 40 carries fresh brine into the anolyte disengager 31 and is best seen in FIG. 1. The fresh brine is then appropriately fed into each anode frame 12 with the existing anolyte fluid, which is recirculated from the anolyte disengager 31 into each anode frame 12 via the anode downcomers 28. An anolyte outlet pipe 41 is also partially shown and serves to control the level of liquid in the anolyte fluid within the anolyte disengager 31 by removing the spent brine from the disengager 31 for regeneration.

Also partially shown in FIG. 1 are a catholyte bottom infeed manifold 42 and an anolyte bottom infeed manifold 44, which are used to drain the appropriate electrodes.

The filter press membrane cell 10 has been described only generally since the structure and function of its central components are well known to one of skill in the art.

Turning now to FIG. 2, there is shown in partial sectional view a diagramatic illustration of three electrodes adjacently positioned from the filter press membrane electrolytic cell 10. The cathodes 11 have cathode frames 45 to which are fastened the opposing cathodic surfaces 46. The anode 12 has anode frame 48 to which is fastened the opposing anodic surfaces 49. Membranes 20 separate the adjacent anodic surfaces 49 and cathodic surfaces 46. Gaskets 50 may be employed between the adjacent cathode frames 45 and anode frames 48 to effect a liquid-tight seal. To prevent tearing of the membrane between the adjacent gaskets 50, lubricating strips 47 may be placed on one or both sides of the membrane 20 between the gaskets 50. For example, if desired, the lubricating strips 47 may be placed between only the membranes 20 and the gaskets 50 adjacent to the cathodic surfaces 46.

The lubricating strips 47 may be in the form of an adhesive on one side of approximately the same width as the gaskets 50 and about 10 mils thick. The lubricating strip 47 may be formed from polytetrafluoroethylene tape sold by the E. I. DuPont de Nemours and Company under the tradename TEFLON or a trifluoroethylene and ethylene copolymer sold by the Asahi Glass Company under the tradename AFLON. The lubricating strip may also be comprised of any other suitable fluorocarbon material that provides a lubricated surface adjacent the membrane 20 to permit the gasket 50 to deform outwardly when subjected to the compressive forces applied to the electrolytic cell 10 during cell assembly and operation. The lubricating strip 47 permits the gasket 50 to slip with the lubricating strip 47 along the membrane 20-lubricating strip 47 interface during gasket 50 deformation, thereby avoiding tearing or breaking of the membrane 20.

The lubricating strip 47 is also especially useful along the cathode frame 45-gasket 50-membrane 20 assembly when inserted between the gasket 50 and the membrane 20. Some membranes 20 have fibers that protrude from the main membrane surface area adjacent the gasket 50 on the cathode 11 side of the electrolytic cell 10. These fibers can adhere to the gasket 50 after assembly. When attempting to disassemble an electrolytic cell 10 to replace a damaged membrane 20, or for any other purpose, the sticking of these fibers to the gasket can cause the membrane to split or tear. This is especially prevalent where gum rubber is employed as the gasket 50 material.

The gasket 50 material is selected with any suitable hardness that will permit the gasket 50 to deform or fill in irregularities in the frame members to permit reduced tolerances to be employed in manufacturing. Normally a low degree of hardness is preferred. Different gasket material may be chosen for use on the anode and cathode sides of the electrolytic cell 10 adjacent the lubricating strips 47 and the membranes 20. Suitable materials for use in the gaskets 50 are elastomers such as synthetic rubbers sold under the trade names Neoprene and Hypalon sold by E. I. DuPont de Nemours, ethylene-propylene-diene monomer (EPDM) or gum rubber.

Anolyte infeed pipes 51 (only one of which is shown) can extend upwardly through the bottoms of anode frames 48 of anodes 12 as seen in FIG. 2. Similarly, catholyte infeed pipes 52 extend upwardly through the bottoms of cathode frames 45 of cathodes 11. Couplings 54 permit the catholyte infeed pipes 52 to be removably connected to the catholyte bottom infeed manifold 42. Anolyte infeed pipes 51, only one of which is shown, also have couplings (not shown) which permit the anolyte bottom infeed manifold 44 to be removably connected thereto.

As seen in FIG. 2, a test liquid 55 has been injected upwardly through the catholyte bottom infeed manifold 42 and the catholyte infeed pipes 52 to fill the cathodes 11 to a desired level. A structurally damaged membrane 20′ is shown with the structural damage indicated at location 56. The structural damage at location 56, generally any sort of a perforation that permits liquid to pass through, permits back migration of the electrolyte caustic into the anode 12. In FIG. 2, this back migration is indicated by the drip of test liquid 55 into the adjacent anode 12.

The following method may be employed when electrolytic cell monitoring determines that there is reduced cathode current efficiency and reduced anode current efficiency in the operating conditions of the cell. Titration of the spent brine confirming an increase in the presence of oxychlorides and gas chromatographs of the cell gas confirming an increase in the presence of oxygen normally indicate a structurally damaged membrane within the operating electrode cell unit. Upon such detection, the location of the structurally damaged membrane may be determined by the following method.

The electrolytic cell 10 is electrically disconnected from the electrical power source and the power supply line. This is done by removing the intercell connectors (not shown) connecting the anode bus (not shown) and the cathode bus 25 from the adjacent cells. The deionized water infeed line or catholyte replenisher conduit 38 is disconnected or appropriately shut off, such as by means of a valve, to prevent the continued flow of deionized water into the cell 10. Similarly, the fresh brine infeed line or anolyte replenisher conduit 40 is disconnected or shut off, such as by an appropriate valving mechanism, to prevent the continued flow of fresh brine into the electrolytic cell 10.

The cathodes 11 and anodes 12 are then drained of all electrolyte through the catholyte bottom infeed manifold 42 and the anolyte bottom infeed manifold 44. This may be accomplished by either disconnecting the conduits or flow pipes (not shown) which connect to these manifolds or the use of a valve system in the conduits or flow pipes which permits the electrolyte to predrain out from the catholyte bottom infeed manifold 42 and the anolyte bottom infeed manifold 44.

When the electrolyte is completely drained from both the cathodes 11 and anodes 12, the anolyte bottom infeed manifold 44 is disconnected by means of the couplings (not shown) and removed. Once thus removed, the cathodes 11 are ready to be filled with a test liquid. The test liquid can be fed into the cathodes 11 in any appropriate manner, either individually one at a time or simultaneously all at one time. A preferred method is the feeding of the test liquid into the cathodes 11 from the bottom. This may be accomplished by connecting a test liquid feed line to the catholyte bottom infeed manifold 42. The test liquid 55 is forced into the manifold 42 and upwardly through the catholyte infeed pipes 52 into the individual cathodes 11. The test liquid 55 is only put into the cathodes 11 and is filled to levels so that the membranes 20 separating the adjacent anodes 12 and cathodes 11 are totally covered by the test liquid 55. This is generally to the level that the test liquid 55 rises up into the cathode risers 29.

Any cathodes 11 that are adjacent to structurally damaged membranes 20' will have the test liquid 55 pass therethrough into the adjacent anode 12. The test liquid 55 will drip down into the bottom of the anode 12, accumulating at the bottom of the anode frame 48 and passing outwardly through the anolyte infeed pipe 51. When this flow of test liquid 55 draining out of the bottom of the anode 12 adjacent the structurally damaged membrane 20' is observed, the location of the structurally damaged membrane has been thus determined to be adjacent to the anode 12 from which the test liquid 55 is draining. The electrolytic cell 10 can then be separated by the method explained in detail hereinafter to expose the structurally damaged membrane 20'. The damaged membrane may be inspected and removed from this electrolytic cell 10, if necessary. Since the structurally damaged membrane could be on the adjacent membrane, shown as membrane 20 in FIG. 2, the electrolytic cell 10 should also be broken apart at the adjacent membrane 20-anode 12 interface to ensure that there is no structural damage to the opposing membrane 20.

It is to be noted that test liquid 55 can equally well be filled into the anode 12 with the anolyte infeed manifold 44 left connected to the electolytic cell 10 and the catholyte bottom infeed manifold 42 removed. Structurally damaged membrane 20' still permits the test liquid to pass from the anode 12 adjacent the structurally damaged membrane 20' into the adjacent cathode 11 from which the test liquid 55 could be seen draining through the bottom catholyte infeed pipe 52.

Once the location of a structurally damaged membrane 20' is determined, the filter press membrane cell 10 is ready for disassembly. The cathode bus 25, the anode bus (not shown), the catholyte bottom manifold in feed 42 and the anolyte bottom manifold in feed 44 are removed. If not previously removed, the anolyte disengager 31 and the catholyte disengager 32 are also taken off of the electrolytic cell 10. The electrolytic cell 10 is then placed in a horizontal position so that the cathodes 11 and anodes 12 are positioned generally horizontally with the damaged membrane 20' closest to the top of the cell stack 57. The topmost backplate or end plate of the side frame members 14, 15, and 16, as seen in FIG. 1, is removed by removing the retaining nuts on the tie bolts 18 and sliding the end plate out of the tie bolts 18. This then exposes the first cathode 11 in the cell stack 57.

Figure 3:
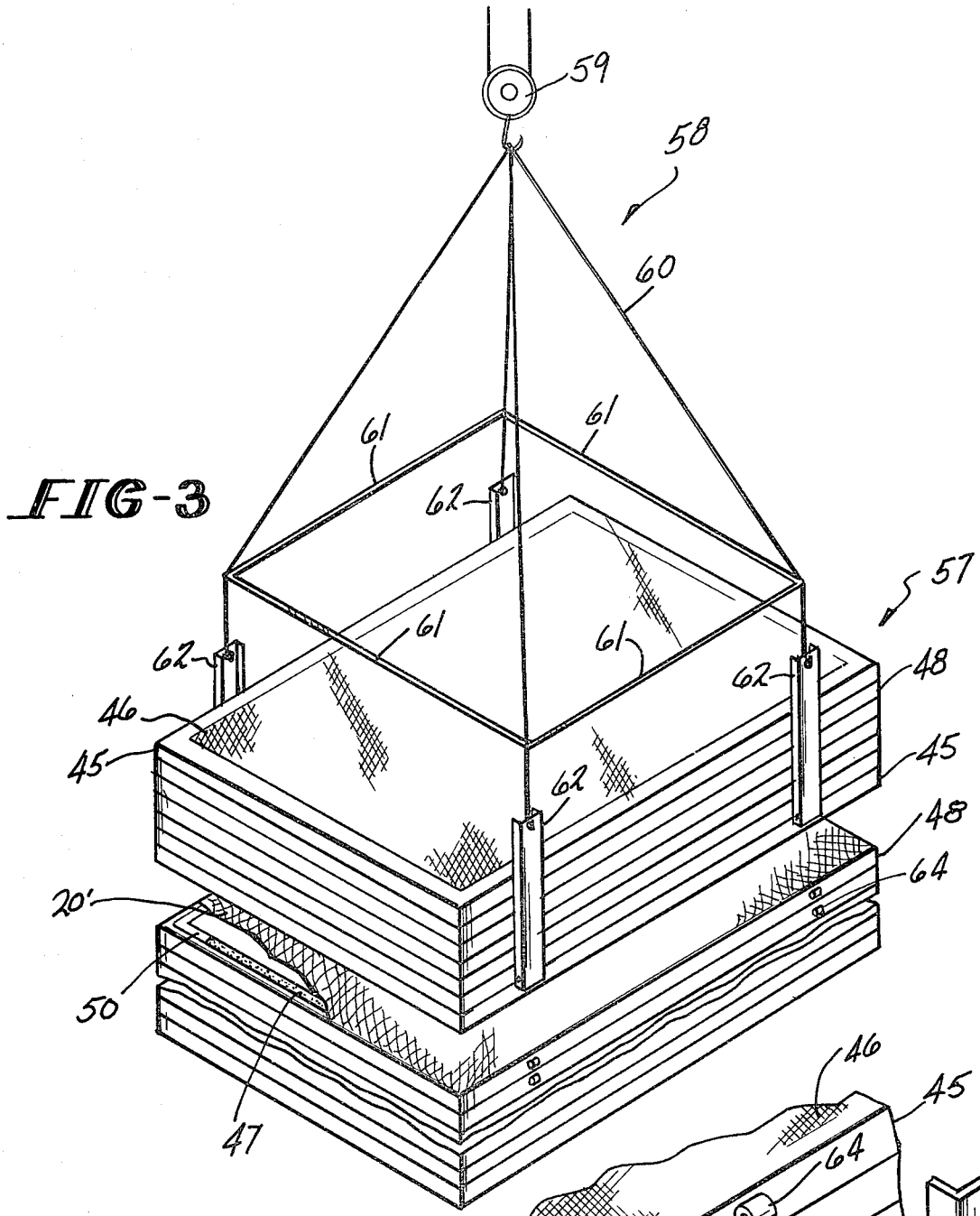
FIG. 3 is a diagrammatic illustration of the lifting fixture employed to separate a cell stack of electrodes into two distinct units with the electrolyte and electrical connections removed for simiplicity.

A lifting fixture indicated generally by the numeral 58 in FIG. 3, is then employed to separate the cell stack 57 into two distinct units. The lifting fixture 58 comprises a lifting means 59, such as a crane or lifting hoist, and a sling 60. A sling spreader 61, which may be in the form of metal channels, keeps the sling 60 spread apart over the four points of connection of the sling 60 to the upper portion of the cell stack 57 that is to be raised.

Figure 4:
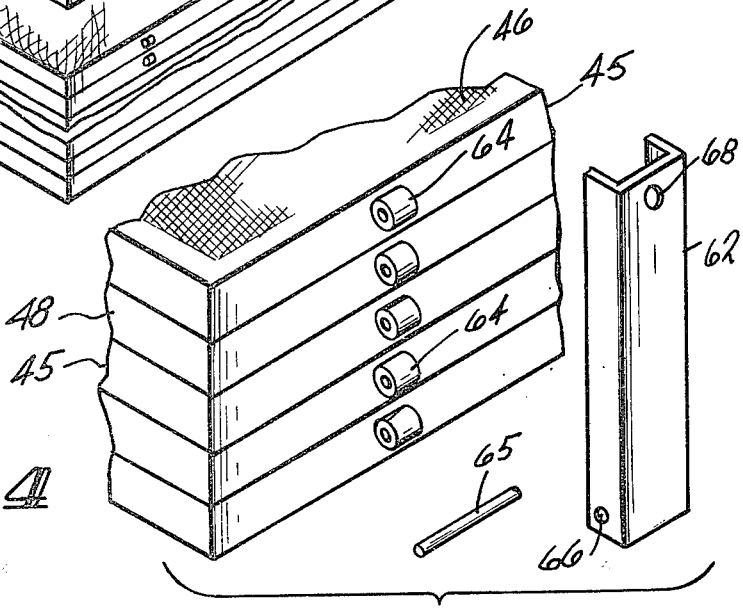
FIG. 4 is an enlarged partial front perspective view showing how the lifting fixture bracket or channel is connected to the electrode frames.

These points of connection to the upper portion of the cell stack 57 are at the channels 62, seen in FIGS. 3 and 4. Channels 62 comprise a three-sided channel having apertures or lifting hook holes 68 in the outwardly facing side and two lifting lug pin holes 66 (only one of which is shown in FIG. 4) in the lower portion of the opposing sides of channel 62. The depth of the opposing sides of channel 62 is sufficient to permit the channel to be placed over the hollow electrode lifting lugs 64. The hollow electrode lifting lugs 64 are fixedly fastened, such as by welding, to the sides of the cathode frames 45 and anode frames 48. There are two lifting lugs 64 on each of two opposing side of each cathode frame 45 and anode frame 48. The lifting lugs 64 are hollow to permit a lifting lug pin 65, as seen in FIG. 4, to insert through the lifting lug pin holes 66 in the opposing sides of channel 62 and through the hollow lifting lug 64 to form a secure fastening point at each channel location about the cathode frames 45 and anode frames 48.

The channels 62 are connected to the sling 60 by means of a hook that passes within the lifting hook hole 68 or which may be inserted with eye bolts (not shown) that may alternately be screwed into the the threaded lifting hook holes 68. The channels 62 are fastened via the lifting lug pins 65 to the appropriate electrode frame immediately above the structurally damaged membrane which has been identified as previously described. When all four channels 62 are connected to the same electrode frame, the lifting hoist 59 may be employed to raise the entire lifting fixture 58 with the upper portion of the cell stack 57 to create two separate and distinct cell stack 57 units of electrode frames.

The channels 62 may be made from four inch steel channel, for example, of the desired length and drilled for attachment to the electrode lifting lugs 64 by appropriately lifting lug holes 66 to permit the lifting lug pin 65 to pass therethrough. The open topped channel provides two contact surfaces with the electrode frames on the opposing sides to supply rigidity to the lifting fixture 58 and to prevent shifting of the cell stack 57 as it is being lifted. Any shift of the cell stack 57 at any time during the assembly or disassembly operation would increase the possibility of damaging the other membranes 20 in the cell stack 57.

Once the cell stack 57 is broken apart at the appropriate membrane 20-cathode 11 or membrane 20-anode 12 interface, the raised portion of the now two unit cell stack 57 is swung up and away from the remaining portion of the cell stack 57 and appropriately set in a resting place. This uncovers the membrane 20', as seen in FIG. 3. Membrane 20' may be inspected to determine whether it is in fact structurally damaged. At this time, an inspection can also be made of the gasket 50 and the lubricating strip 47 that is placed on top of the gasket 50 so that it is positioned between the gasket 50 and the membrane 20.

In operation, a structurally damaged membrane is located via the aforementioned method or by any other suitable method. The anolyte and catholyte disengagers, 31 and 32 respectively, if not already removed from the cell, must be removed prior to disassembly. Additionally, the anode bus (not shown) and the cathode bus 25, as well as the catholyte bottom manifold infeed 42 and anolyte bottom manifold infeed 44 must be removed. The filter press membrane electrolytic cell 10 is then placed in a horizontal position with the structurally damaged membrane 20' nearest the top of the cell stack 57. The back plate or end plate comprised of the vertical frame members 14, horizontal side frame members 15, and intermediate vertical side frame members 15, nearest the structurally damaged membrane is then removed.

The channels 62 are then attached to the lifting lugs 64 of the electrode frame immediately over the location of the structurally damaged membrane 20'. After each of the four channels 62 is attached to the frame via the insertion of the lifting lug pin 65 through the lifting lug pin holes 56 and the hollow lifting lug 64, the sling 60 is attached to each of the channels 62 at the lifting hook hole 68. The sling spreader 61 is properly positioned within the sling 60. The lifting means 59, such as a hoist or crane, is then connected to the sling 60 and the cell stack 57 is split into two separate units by raising the topmost unit with the lifting fixture 58. This exposes the structurally damaged membrane 20' in the remaining lower unit of the cell stack 57. This membrane may then be inspected for damage and replaced, if necessary. The gasket 50 and the lubricating strip 47 may also be inspected. The electrolytic cell 10 should also be broken apart at the adjacent membrane 20-electrode interface, or the next lower membrane, to insure that there is no structural damage to this next lower membrane 20.

Any damaged membranes 20' or gaskets 50 or lubricating strips 47 are replaced. The electrode frames are repositioned in the lower unit of the cell stack and the upper unit of the cell stack 57 is then replaced by use of the lifting means 59. The upper unit of the cell stack is replaced on top of the lower unit of the cell stack 57. The top back or end plate is replaced on top of the cell stack 57 and the tie rods are refastened.

The cell stack 57 is then raised from the generally horizontal position shown in FIG. 3 to the generally vertical position illustrated in FIG. 1 and the remaining components of the electrolytic cell 10 that were removed prior to disassembly are then reattached, such as the catholyte bottom manifold infeed 42 and the anolyte bottom manifold infeed 44. The anode bus (not shown) and the cathode bus 25, as well as the anolyte disengager 31 and the catholyte disengager 32 are reattached. The deionized water infeed line or catholyte replenisher conduit 38 is reconnected to permit the flow of deionized water into the cell 10. Similarly, the fresh brine infeed line or anolyte replenisher conduit 40 is reconnected. The intercell connectors (not shown) are connected between the disassembled cell and the adjacent cells on line and the electrical power source reconnected, such as through the use of a jumper switch once the electrolyte has been replaced in cell 10.

Prior to actually connecting the electrolytic cell 10 into the operating bank of cells, it is wise to recheck the liquid-tightness of the seals, and the integrity of the membranes 20 by repeating the aforedescribed method to determine the location of a structurally damaged membrane 20'. If there are no leaks of the test liquid 55 from adjacent electrodes, or there is no leakage from between the adjacent electrodes, it can then be assumed that the cell has been properly reassembled and is ready for remaining connection to the operating electrolytic cells 10 in the cell bank.

An alternative method of locating a structurally damaged membrane may be employed. In this method the electrolytic cell 10 is disconnected from the electrolytical power source, the fresh brine or anolyte replenisher conduit 40 and the deionized water or catholyte replenisher conduit 38 are disconnected or shut off, and the electrolyte is drained from the electrolytic cell as accomplished in the previous method. However, the anolyte infeed manifold 44 is removed from the electrolytic cell and replaced with a valved infeed manifold that permits the individual anodes 12 to be isolated from each other so that test liquid level equilibration between anodes 12 by flow through the infeed manifold 44, into the adjacent anodes 12 does not occur. Referring again to FIG. 2, the anodes 12 and the cathodes 11 are then filled with the test liquid 55. However, a predetermined positive differential, preferably approximately twenty inches between the fill height of the test liquid 55 in the cathodes 11 and the fill height of the test liquid 55 in the anodes 12 is maintained. The filling of the cathodes 11 and the anodes 12 with the test liquid 55 is stopped when the test liquid 55 flows out of the top product nozzle or cathode riser 29 of each cathode 11. Each individual anode 12 is isolated by using the shut off valves on the new anolyte infeed manifold. The test liquid 55 will then pass through the structurally damaged membrane 20' into the adjacent anode 12. This will cause the level of test fluid in the anode 12 adjacent the structurally damaged membrane 20' to rise in height until the level of test liquid 55 between the adjacent cathode 11 and anode 12 are almost equal. By this method, the location of the anode adjacent the structurally damaged membrane can be determined. The cell 10 is then separated as before.

Additionally, in the second method of locating a structurally damaged membrane, a compatible dye or other indicator can be used in the test liquid 55 put in the cathodes 11 so that the flow of test liquid 55 across a structurally damaged membrane 20' will be visibly noticeable. Air or other compatible gases can also be employed to pressurize the desired chamber, either cathode 11 or anode 12, to detect the leak through the structurally damaged membrane 20'. This second method of locating a structurally damaged membrane could equally well reverse the positive test liquid differential and maintain a predetermined positive test liquid fill height differential on the anodes 12, as well as replacing the catholyte infeed manifold 42 with a valved infeed mainfold to effect test liquid 55 isolation between the adjacent cathodes 11.

The instant method of locating and replacing a structurally damaged membrane or electrode separator can be employed equally well in electrolytic cells using a finite gap between the membrane or separator and the adjacent electrode surfaces or in electrolytic cells where the membrane or separator is in contact with or bonded to the adjacent electrode surfaces.

It should also be noted that this procedure may be employed on bipolar or monopolar filter press membrane cells and any type of hydraulically impermeable ion exchange membrane may be used as the electrode separator between the adjacent electrode. In the case of bipolar cells, alternate adjacent electrodes, sandwiched about the electrode separator, would be filled with the test liquid. The other empty adjacent electrode would then be observed for leakage of any of the test liquid through the structurally damaged separator into the empty compartment. The cell would then be separated by the method described previously herein.

The aforementioned method of breaking apart a multiunit filter press electrolytic cell with the lifting, fixture 58 and the channels 62 is also readily employed to replace faulty gaskets 50 that may no longer be liquid-tight. The same advantage of maintaining the structural integrity of the remainder of the cell and avoiding shifting of the electrode frames that might damage the membranes 20 is achieved. Again, the entire cell stack 57 need not be broken apart frame by frame until the faulty gasket is reached.

While the preferred structure in which the principles of the present invention have been incorporated is shown and described above, it is to be understood that the invention is not to be limited to the particular details thus presented, but in fact, widely different means may be employed in the practice of the broader aspects of the method of this invention. The scope of the appended claims is intended to encompass all obvious changes in the details, materials and method of utilizing the parts which will occur to one of skill in the art upon a reading of the disclosure.

Having thus described in the invention, what is claimed is:

1. A method of replacing a structurally damaged membrane in a filter press membrane electrolytic cell containing electrolyte having an anode bus, a cathode bus, an anolyte infeed manifold, a catholyte infeed manifold, a deionized water infeed, a brine infeed, a product caustic outlet, a product chlorine outlet, and a plurality of anodic and cathodic electrodes, each pair of anodes and cathodes being sandwiched about a membrane, comprising:

a. electrically disconnecting the electrolytic cell from the electrical power source;
b. disconnecting and sealing the brine and deionized water infeed;
c. draining the electrolyte from the electrolytic cell;
d. determining the location of the electrode adjacent the structurally damaged membrane;
e. removing the catholyte infeed manifold;
f. removing the anolyte infeed manifold;
g. removing the anode bus;
h. removing the cathode bus;
i. placing the electrolytic cell in a horizontal position to form a cell stack;
j. removing the back plate from the electrolytic cell;
k. connecting a lifting fixture to the electrode immediately above the electrode adjacent the structurally damaged membrane;
l. breaking the stack apart into two units by raising the lifting fixture connected to the electrode immediately above the electrode adjacent the structurally damaged membrane;
m. inspecting the structurally damaged membrane;
n. replacing the structurally damaged membrane;
o. reassembling the cell stack into one unit; and
p. reassembling the electrolytic cell and reconnecting the cell electrolytic and electrical connections.

2. The method according to claim 1 wherein the step of determining the location of the electrode adjacent the structurally damaged membrane further comprises:

a. filling the cathodes with a test liquid;
b. having the test liquid pass through a structurally damaged membrane into the adjacent anode; and
c. observing the test liquid in the anode adjacent the structurally damaged membrane.

3. The method according to claim 2 further comprising feeding the test liquid into the cathodes through the catholyte infeed manifold.

4. The method according to claim 2 further comprising using water as the test liquid.

5. The method according to claim 2 further comprising using a brine as the test liquid.

6. The method according to claim 2 further comprising using caustic as the test liquid.

7. The method according to claim 1 wherein the step of determining the location of the electrode adjacent the structurally damaged membrane further comprises:

a. filling the anodes with a test liquid;
b. having the test liquid pass through a structurally damaged membrane into the adjacent cathode; and
c. observing the test liquid in the cathode adjacent the structurally damaged membrane.

8. The method according to claim 7 further comprising feeding the test liquid through the anolyte infeed manifold into the anodes.

9. The method according to claim 7 further comprising using water as the test liquid.

10. The method according to claim 7 further comprising using a brine as the test liquid.

11. The method according to claim 7 further comprising using caustic as the test liquid.

12. The method according to claim 1 further comprising using a sling, a sling spreader and a plurality of channels as the lifting fixture.

13. The method according to claim 12 further comprising the steps of:

a. fastening the bottom of each of the channels to lifting lugs on the electrode frame immediately above the electrode adjacent the structurally damaged membrane; and b. fastening the top of each of the channels to the sling.

14. The method according to claim 13 further comprising using a lifting means to raise the cell stack to break the cell stack apart into two units so that the topmost unit is supported by the sling and the remaining lower unit contains the structurally damaged membrane.

15. The method according to claim 14 further comprising removing a gasket and lubricating strip adjacent a structurally damaged membrane prior to inspecting the structurally damaged membrane.

16. The method according to claim 15 further comprising breaking the remaining lower unit of the cell stack apart at the adjacent membrane-electrode interface prior to replacing the structurally damaged membrane to check for damage prior to replacing the structurally damaged membrane.

17. The method according to claim 16 further comprising the steps of:

a. replacing the gasket and lubricating strip; and b. replacing the electrode to reestablish the adjacent membrane-electrode interface.

18. The method according to claim 1 further comprising the steps of:

a. replacing the anolyte infeed manifold with a valved infeed manifold that permits the isolation of the individual anodes;

b. filling the anodes and the cathodes with a test liquid while maintaining a predetermined positive cathode to anode differential in fill height level;

c. stopping the filling of the anodes and the cathodes with test liquid when the cathodes are filled;

d. isolating each individual anode by using the shut-off valves on the valved infeed manifold;

e. having a test liquid pass through a structurally damaged membrane into the adjacent anode; and f. observing the test liquid level in each of the anodes to determine which anode has the liquid level rising to locate the anode adjacent the structurally damaged membrane.

19. The method according to claim 1 further comprising the steps of:

a. replacing the catholyte infeed manifold with a valved infeed manifold that permits the isolation of the individual cathodes;

b. filling the anodes and the cathodes with a test liquid while maintaining a predetermined positive anode to cathode differential in fill height level;

c. stopping the filling of the anodes and the cathodes with test liquid when the anodes are filled;

d. isolating each individual cathode by using the shut-off valves on the valved infeed manifold;

e. having a test liquid pass through a structurally damaged membrane into the adjacent cathode; and f. observing the test liquid level in each of the cathodes to determine which cathode has the liquid level rising to locate the cathode adjacent the structurally damaged membrane.

20. A method of breaking apart a filter press membrane electrolytic cell to inspect and replace a gasket or a membrane, the cell being filled with electrolyte and having an anode and cathode bus, cell back plates, an anolyte and catholyte infeed manifold, a brine infeed, a deioinized water infeed, a product caustic outlet, a product chlorine outlet, and a plurality of anodic and cathodic electrodes, each pair of anodes and cathodes being sandwiched about a membrane and having a lubricating strip between at least each cathode and each membrane, comprising;

a. electrically disconnecting the electrolytic cell from the electrical power source;

b. disconnecting and sealing the brine and deionized water infeed;

c. draining the electrolyte from the electrolytic cell;

d. determining the location of the gasket or membrane to be inspected;

e. removing the anolyte infeed manifold and catholyte infeed manifold;

f. removing the anode bus and cathode bus;

g. placing the electrolytic cell in a horizontal position to form a cell stack having a top and a bottom with the gasket or membrane to be inspected closest to the top of the cell stack;

h. removing the cell end plate nearest the top of the cell stack;

i. connecting a lifting fixture to the electrode immediately above the electrode adjacent to the gasket or membrane to be inspected;

j. breaking the cell stack apart into two units by raising the lifting fixture and the top unit of the cell stack immediately above the electrode adjacent the gasket or membrane to be inspected;

k. inspecting the gasket and membrane;

l. replacing the lubricating strip and the gasket;

m. reassembling the cell stack into one unit; and n. reassembling the electrolytic cell and reconnecting the cell electrolyte and electrical connections.

21. The method according to claim 20 further comprising replacing the membrane prior to replacing the lubricating strip and the gasket.

* * * * *